US010190604B2

(12) United States Patent
Dostinov

(10) Patent No.: US 10,190,604 B2
(45) Date of Patent: Jan. 29, 2019

(54) PISTON AND MAGNETIC BEARING FOR HYDRAULIC HAMMER

(71) Applicant: Caterpillar Inc., Peoria, IL (US)

(72) Inventor: Dimitar Dostinov, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 492 days.

(21) Appl. No.: 14/920,485

(22) Filed: Oct. 22, 2015

(65) Prior Publication Data

US 2017/0113337 A1 Apr. 27, 2017

(51) Int. Cl.

| | |
|---|---|
| ***F15B 11/08*** | (2006.01) |
| ***B25D 9/04*** | (2006.01) |
| ***B25D 17/06*** | (2006.01) |
| ***B25D 9/12*** | (2006.01) |
| ***E02F 3/96*** | (2006.01) |
| ***E02F 9/20*** | (2006.01) |

(52) U.S. Cl.

CPC ..... *F15B 11/08* (2013.01); *B25D 9/04* (2013.01); *B25D 9/12* (2013.01); *B25D 17/06* (2013.01); *E02F 3/966* (2013.01); *E02F 9/2095* (2013.01); *B25D 2217/0019* (2013.01); *B25D 2217/0023* (2013.01); *B25D 2250/145* (2013.01); *B25D 2250/331* (2013.01)

(58) Field of Classification Search

CPC ..... B25D 9/04; B25D 11/064; B25D 17/06; B25D 2217/0019; B25D 2217/0023; B25D 2250/145; B25D 9/12; F15B 11/08

USPC ..... 173/114, 117, 118, 201–206, 121, 212

See application file for complete search history.

(56) References Cited

U.S. PATENT DOCUMENTS

| | | | | |
|---|---|---|---|---|
| 2,402,920 A | | 6/1946 | Seibold | |
| 3,946,926 A | * | 3/1976 | Willis | B25B 23/04 227/112 |
| 4,041,764 A | * | 8/1977 | Sabloewski | B01L 3/0224 422/925 |
| 4,353,426 A | * | 10/1982 | Ward | B25D 11/064 173/202 |
| 5,219,034 A | | 6/1993 | Wortham | |
| 5,231,352 A | * | 7/1993 | Huber | G01D 5/145 324/207.13 |
| 5,479,946 A | * | 1/1996 | Trumble | A61M 1/1015 128/899 |
| 5,497,555 A | * | 3/1996 | Averbukh | B25D 11/064 173/117 |

(Continued)

FOREIGN PATENT DOCUMENTS

| | | |
|---|---|---|
| CN | 203390894 U | 1/2014 |
| GB | 923732 A | 4/1963 |

*Primary Examiner* — Robert Long

(74) *Attorney, Agent, or Firm* — Leydig, Voit & Mayer, Ltd.

(57) ABSTRACT

A hydraulic hammer includes a power cell. A work tool is partially received in, and movable with respect to, the power cell. A sleeve is positioned in the power cell that defines a centerline. A piston is concentrically positioned in the sleeve and movable in the sleeve between a first position in contact with the work tool and a second position out of contact with the work tool. A magnetic guide system includes at least one of a first magnetic guide component disposed in the piston and at least one of a second magnetic guide component disposed in the sleeve that interact to produce magnetic repellent forces therebetween to urge the radial position of the piston towards the center line.

15 Claims, 6 Drawing Sheets

(56) References Cited

U.S. PATENT DOCUMENTS 6,520,269 B2 * 2/2003 Geiger ..... B25D 11/064 173/114
6,736,614 B1 * 5/2004 Bahnen ..... F04B 35/045 417/417
6,799,644 B2 10/2004 Hoop et al.
7,025,183 B2 * 4/2006 Steffen ..... B25D 11/064 173/114
7,331,271 B2 2/2008 Sanderson et al.
7,667,356 B2 2/2010 Togare
7,859,144 B1 * 12/2010 Sahyoun ..... H02K 33/16 310/14
8,151,899 B2 * 4/2012 Tuomas ..... B25D 9/145 173/1
9,662,777 B2 * 5/2017 Pomeroy ..... B25C 1/041
2005/0076517 A1 * 4/2005 Steffen ..... B25D 11/064 30/362
2005/0194187 A1 * 9/2005 Gleitman ..... E21B 4/04 175/57
2006/0213365 A1 * 9/2006 Dorr ..... F15B 1/24 92/5 R
2007/0114064 A1 * 5/2007 Hall ..... E21B 4/00 175/57
2007/0221408 A1 * 9/2007 Hall ..... E21B 4/06 175/57
2008/0175721 A1 * 7/2008 Yang ..... F04B 9/00 417/53
2008/0197721 A1 * 8/2008 Reyes ..... H02K 7/075 310/24
2008/0314608 A1 * 12/2008 Berger ..... B25D 11/064 173/132
2009/0000672 A1 * 1/2009 Goll ..... G05B 19/0421 137/487.5
2009/0152959 A1 * 6/2009 Vollmer ..... H02K 41/031 310/12.22
2009/0191073 A1 * 7/2009 Kopecek ..... F04B 17/04 417/415
2009/0267324 A1 * 10/2009 Macek ..... A63C 5/07 280/602
2010/0212967 A1 * 8/2010 Powell ..... E21B 28/00 175/106
2010/0236802 A1 * 9/2010 Berger ..... B25D 11/064 173/118
2011/0020156 A1 * 1/2011 Van Brunt ..... F04B 17/04 417/416
2011/0108600 A1 * 5/2011 Pedicini ..... B25C 1/047 227/2
2012/0112469 A1 * 5/2012 Durrett ..... F01B 11/007 290/1 A
2013/0034456 A1 * 2/2013 Schoegler ..... F04B 17/04 417/410.1
2014/0018713 A1 * 1/2014 Elenga ..... A61H 23/0218 601/78
2014/0054350 A1 * 2/2014 Pedicini ..... B25C 5/15 227/8
2014/0239644 A1 * 8/2014 Hochberg ..... H02K 7/1876 290/54
2014/0374461 A1 * 12/2014 Pedicini ..... B25C 1/06 227/2
2017/0108121 A1 * 4/2017 Kuhns ..... F16K 31/047
2018/0037251 A1 * 2/2018 Nelson ..... B62D 3/14

* cited by examiner

PISTON AND MAGNETIC BEARING FOR HYDRAULIC HAMMER

TECHNICAL FIELD

This disclosure relates generally to hydraulic hammers, and more specifically to magnetic guide systems used in hydraulic hammers.

BACKGROUND

Hydraulic hammers are generally known to include a tool extending partially out of a housing. Such hammers may include a hydraulically actuated power cell having an impact system operatively coupled to the tool. The impact system generates repeated, longitudinally directed forces against a proximal end of the tool disposed inside the housing. The distal end of the tool, extending outside of the housing, may be positioned against rock, stone or other materials to break up those materials. During operation, the hydraulic hammer will form large pieces of broken material as well as stone dust and fine grit. The stone dust may include abrasive material, such as quartz, which could increase wear and cause premature failure of components should it migrate along the tool and into the interior of the hydraulic hammer.

Various seal arrangements have been proposed to address the issue of migrating dust. In many of these devices, the seal is positioned centrally within the housing, near the internal components of the power cell. However, other arrangements of seals and sealing strategies have been proposed, which have resulted in various levels of success in isolating the piston and internal workings of the hydraulic hammer from harmful contamination.

However, despite the presence of various seals, bushings and lubrication in a hydraulic hammer, one of the most common, most critical and most expensive failures for a hydraulic hammer is galling of the piston to the cylinder or sleeve in which the piston reciprocates. There are a number of potential causes of galling, ranging from the presence of harmful contaminants to a lack of precise machining of the piston and cylinder elements and poor quality surface finish.

One use of a hydraulic hammer is tunneling where the hydraulic hammer is used in a horizontal position. Horizontal use of a hydraulic hammer tends to cause more wear on the piston and cylinder assembly. Galling and wear would at least be reduced if it were possible to prevent the piston from mechanically touching the cylinder and if it were possible to maintain a selected clearance between them. Further, galling and wear would be reduced if it were possible to reduce the extent and magnitude of radial motion of the piston within the hydraulic hammer.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In one aspect, the present disclosure describes a hydraulic hammer with a power cell. A work tool is partially received in and is movable with respect to the power cell. A sleeve is positioned in the power cell that defines a centerline. A piston is concentrically positioned in the sleeve and movable in the sleeve between a first position in contact with the work tool and a second position out of contact with the work tool. A magnetic guide system includes at least one of a first magnetic guide component disposed in the piston and at least one of a second magnetic guide component disposed in the sleeve that interact to produce magnetic repellent forces therebetween to urge the radial position of the piston towards the center line.

In other aspects of the disclosure, the magnetic guide system may include an electrodynamic bearing system. The first magnetic guide component may include a first ring magnet and a second ring magnet disposed in an axially spaced apart configuration in the piston. The second magnetic guide component may include a first conductive cylinder and a second conductive cylinder, the first and second conductive cylinders disposed adjacent respective first and second ring magnets. The piston may have a stroke and the first and second ring magnets may have a first axial length, the first axial length greater than the stroke. The first and second ring magnets may have a first axial length and the first and second conductive cylinders may have a second axial length, the first axial length less than the second axial length. The magnetic guide system may include a magnetic suspension system. The first magnetic guide component of the magnetic suspension system may include a first magnetic ring component and a second magnetic ring component disposed in an axially spaced apart configuration in the piston. The first and second magnetic ring components may be permanent magnets. The first and second magnetic ring components may be diametrically magnetized. The second magnetic guide component of the magnetic suspension system may include an array of electromagnetic elements disposed adjacent the first and second permanent magnets. The hydraulic hammer may further include a power source in operative communication with the array of electromagnetic elements. The magnetic guide system may include a diamagnetic suspension system. The first magnetic guide component of the diamagnetic suspension system may include a first diamagnetic ring and a second diamagnetic ring disposed in an axially spaced apart configuration in the piston. The second magnetic guide component of the diamagnetic suspension system may include a first permanent magnet ring and a second permanent magnet ring, the first and second permanent magnet rings disposed adjacent respective first and second diamagnetic rings.

In yet another aspect of the disclosure, a machine includes an implement system attached to the machine. A hydraulic hammer is attached to the implement system, the hydraulic hammer including a power cell. A work tool is partially received in, and movable with respect to, the power cell. A sleeve is positioned in the power cell and defines a centerline. A piston includes a plurality of hydraulic surfaces. The piston is concentrically positioned in the sleeve and movable in the sleeve between a first position in contact with the work tool and a second position out of contact with the work tool. A magnetic guide system includes at least one of a first magnetic guide component disposed in the piston and at least one of a second magnetic guide component disposed in the sleeve that interact to produce magnetic repellent forces therebetween to urge the radial position of the piston towards the center line.

In other aspects of the disclosure, the magnetic guide system may include one of an electrodynamic bearing system, a magnetic suspension system, and diamagnetic suspension system.

The disclosure provides a method of reducing wear in a hydraulic hammer, including providing a hydraulic hammer with a piston and a sleeve concentrically disposed about the piston. A magnetic guide system is disposed in the hydraulic hammer, wherein the magnetic guide system includes at least one of a first magnetic guide component in the piston and at least one of a second magnetic guide component in the sleeve. A first magnetic guide component and the second magnetic guide component are caused to interact to produce magnetic repellent forces therebetween to urge the radial position of the piston towards a center line of the sleeve. The magnetic guide system may include one of an electrodynamic bearing system, a magnetic suspension system, and diamagnetic suspension system.

Further and alternative aspects and features of the disclosed principles will be appreciated from the following detailed description and the accompanying drawings. As will be appreciated, the principles related to a hydraulic hammer with electrodynamic bearings in disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
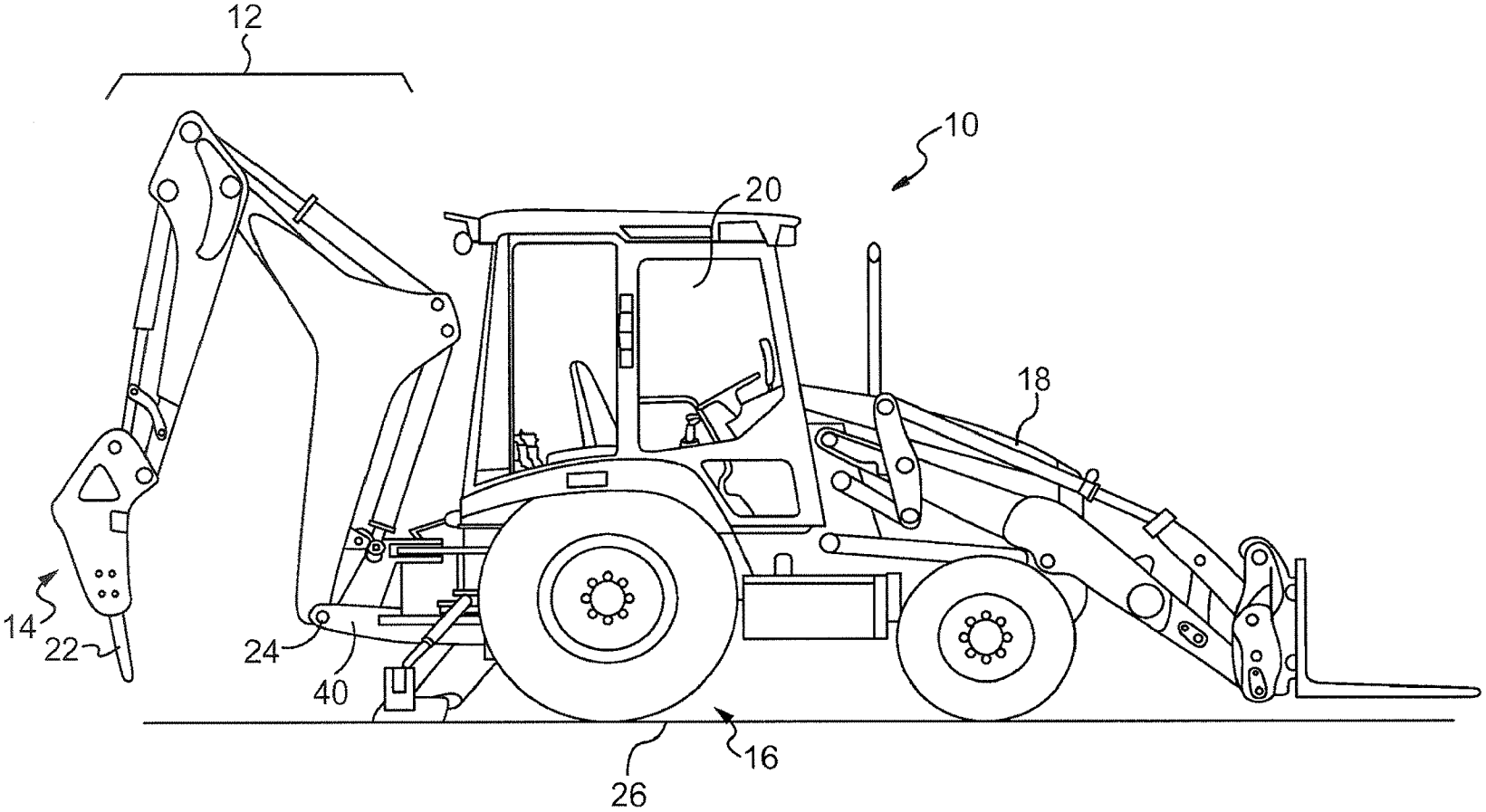
FIG. 1 is a diagrammatic illustration of a machine having a hydraulic hammer.

This disclosure relates to a hydraulic hammer with a magnetic guide system. FIG. 1 illustrates an exemplary machine 10 including a hydraulic hammer 14 that employs a magnetic guide system that functions to maintain alignment of a piston of the hydraulic hammer and thereby reduce or eliminate galling and other effects of misalignment and unintended or undesired motion of the piston. It will be understood that magnetic components employed in the various embodiments of the invention may include use of permanent magnets, electromagnets, ferromagnetism, diamagnetism, superconducting magnets and magnetism due to induced currents in conductors and suitable combinations thereof.

Machine 10 may embody a fixed or mobile machine that performs some type of operation associated with an industry such as mining, construction, farming, transportation, or any other industry known in the art. For example, machine 10 may be an earth-moving machine such as a backhoe, an excavator, a dozer, a loader, a motor grader, or any other earth-moving machine. Machine 10 may include an implement system 12 configured to move the hydraulic hammer 14, a drive system 16 for propelling machine 10, a power source 18 that provides power to implement system 12 and drive system 16, and an operator station 20 for operator control of at least implement system 12 and drive system 16.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, an electrical or mechanical power storage device, or another source known in the art. Power source 18 may produce a mechanical or electrical power output that may then be converted to hydraulic power for moving implement system 12.

Implement system 12 may include a linkage structure acted on by fluid actuators to move the hydraulic hammer 14. The linkage structure of implement system 12 may be complex, for example, including three or more degrees of freedom. The implement system 12 may carry the hydraulic hammer 14 which has a tool 22 for impacting an object or ground surface 26.

Figure 2:
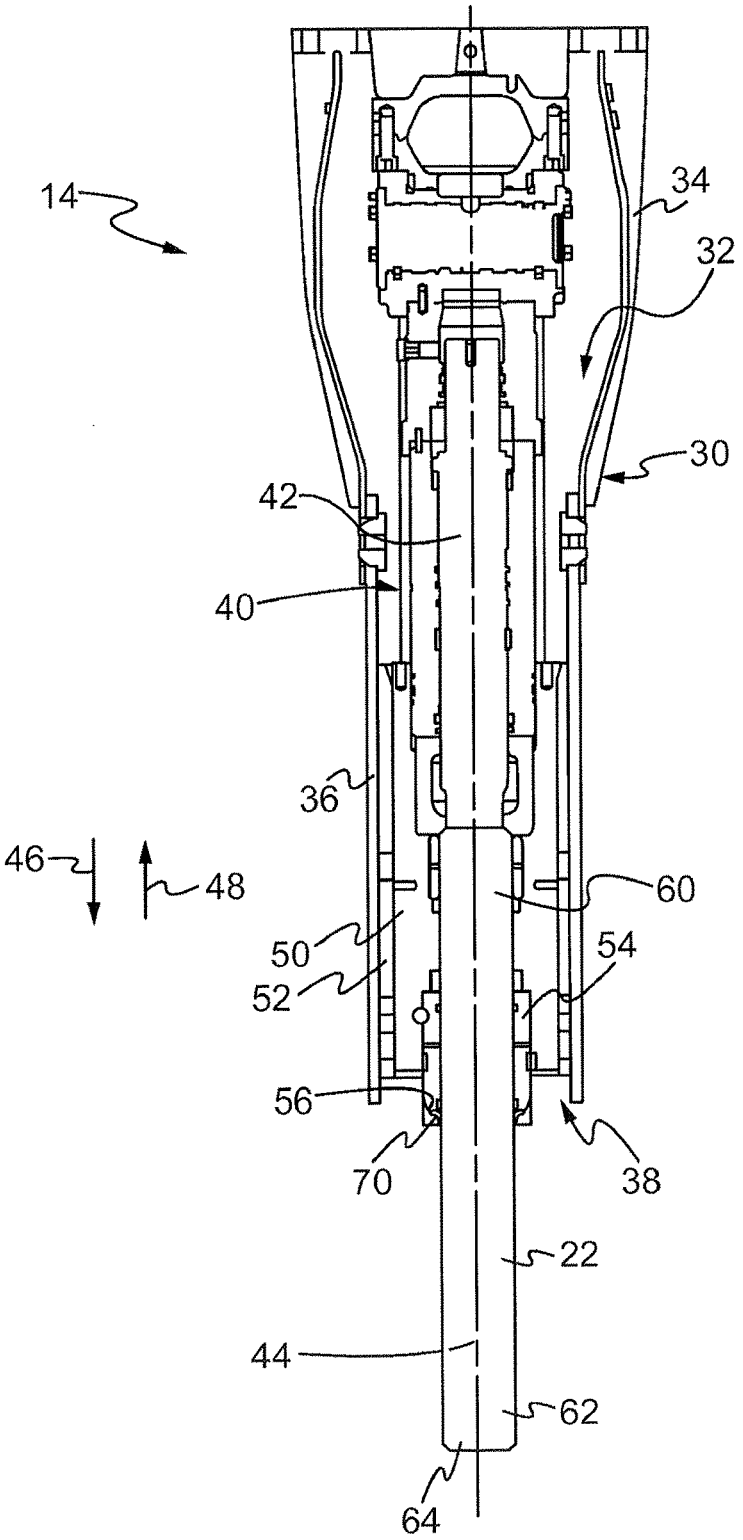
FIG. 2 is a side elevation view, in cross-section, of a hydraulic hammer.

FIG. 2 is a cross-sectional view of the hydraulic hammer 14 of FIG. 1. The hydraulic hammer 14 includes a housing 30 defining a chamber 32. The housing 30 may include an upper housing member 34 and a lower housing member 36 that are welded or otherwise joined together. The upper and lower housing members 34, 36 define upper and lower chambers, respectively, and together make up the chamber 32. A distal end of the housing 30 (i.e., the lower housing member 36) defines an opening 38.

A power cell 40 is disposed inside the housing chamber 32 and includes several internal components of the hydraulic hammer 14. As shown in FIG. 2, a proximal portion of the power cell 40 provides an impact assembly that includes a piston 42. The piston 42 is operatively housed in the chamber 32 such that the piston 42 can translate along a centerline or longitudinal axis 44, which will also be referred to as the centerline, in the general direction of arrows 46 and 48. In particular, during a work stroke, the piston 42 moves in the general direction of arrow 46, while during a return stroke the piston 42 moves in the general direction of arrow 48.

A sleeve 72 is disposed within chamber 32 about piston 42 and aligned with longitudinal axis 44. The sleeve 72 has an inner surface 74 facing the piston 42, which is provided with lubricant to lubricate and support the piston as it moves within the sleeve.

A distal portion of the power cell 40 includes the work tool 22 and structure for guiding the work tool 22 during operation. Accordingly, the power cell 40 includes a front head 50 inserted into the lower housing member 36 with wear plates 52 interposed between the front head 50 and the housing 30. A lower bushing 54 is inserted into a distal end of the front head 50 so that a distal end 56 of the lower bushing 54 is positioned adjacent the distal end of the housing 30. The bushing further defines an inner guide surface 58. The work tool 22 includes a proximal section 60 sized to be slidably received within the inner guide surface 58 of the lower bushing 54. The work tool 22 further has a distal section 62, which projects from the lower bushing 54 and housing 30 through the opening 38.

A hydraulic circuit (not shown) provides pressurized fluid to drive the piston 42 toward the work tool 22 during the work stroke and to return the piston 42 during the return stroke. The hydraulic circuit is not described further, since it will be apparent to one skilled in the art that any suitable hydraulic system may be used to provide pressurized fluid to the piston 42, such as the arrangement described in U.S. Pat. No. 5,944,120. Alternatively, a pneumatic or other type of motive power may be used to drive the piston 42.

In operation, near the end of the work stroke, the piston 42 strikes the proximal section 60 of the work tool 22. The distal section of the work tool 22 may include a tip 64 positioned to engage an object or ground surface 26. The impact of the piston 42 on the proximal section 60 drives the tip 64 into the object or ground surface 26, thereby creating pieces of broken material as well as dust, grit, and other debris. The hydraulic hammer 14 may further include a composite seal 70 for preventing dust and other broken material from migrating along the work tool 22 and into the interior components of the power cell 40.

The piston 42 reciprocates within the sleeve 72. When the piston 42 exhibits undesired motion, i.e., radial displacement, the piston can cause damage to the inner surface 74 of the sleeve. One form of damage is galling, which is a form of wear caused by adhesion between sliding surfaces. Galling can occur if the lubrication property of the lubricating oil is compromised by age, for example, or overwhelmed by sudden and/or large forces.

Figure 3:
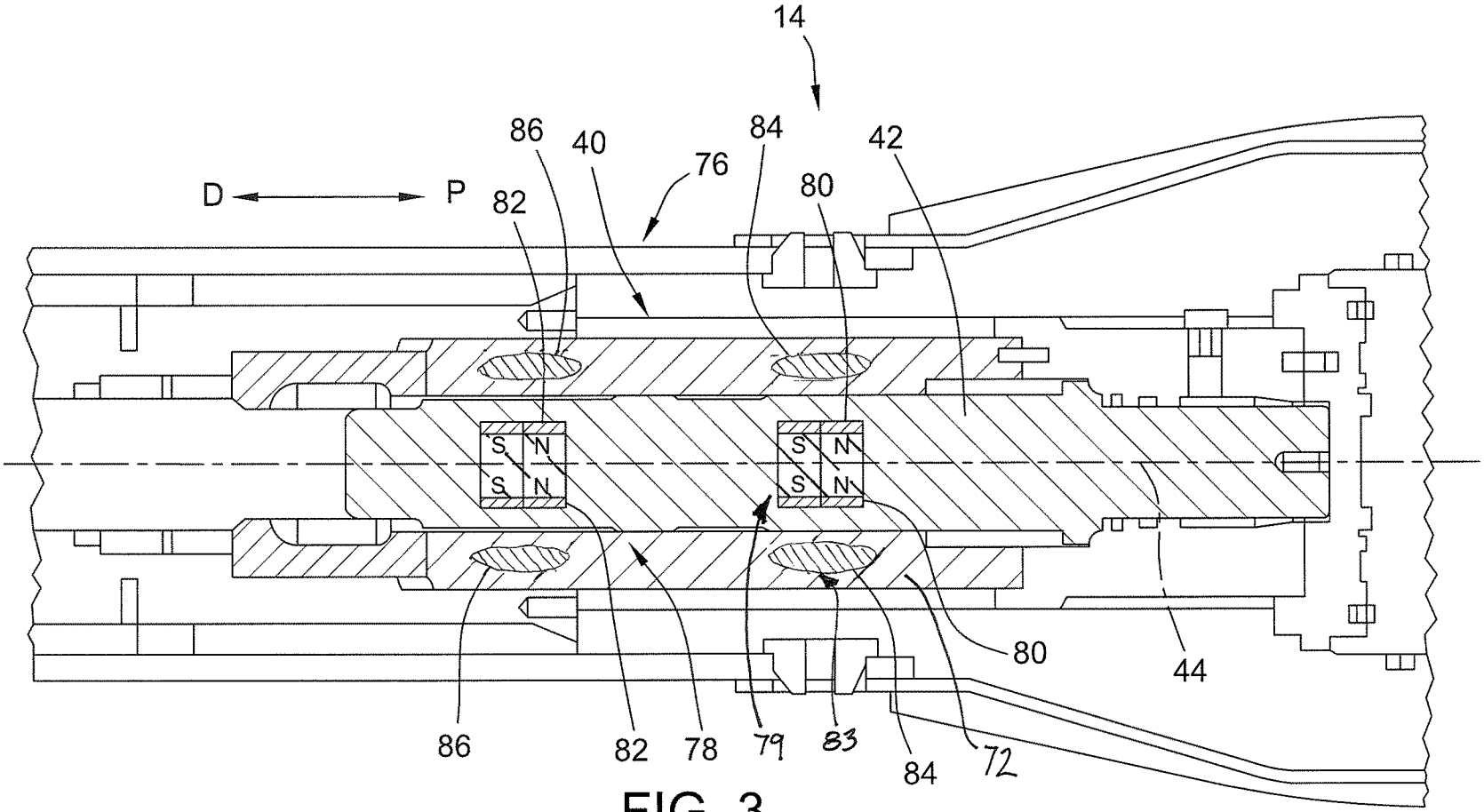
FIG. 3 is a partial cross-section view of the hydraulic hammer of FIG. 2 showing an electrodynamic bearing system in a power cell thereof with a piston at a maximum top working position.
Figure 4:
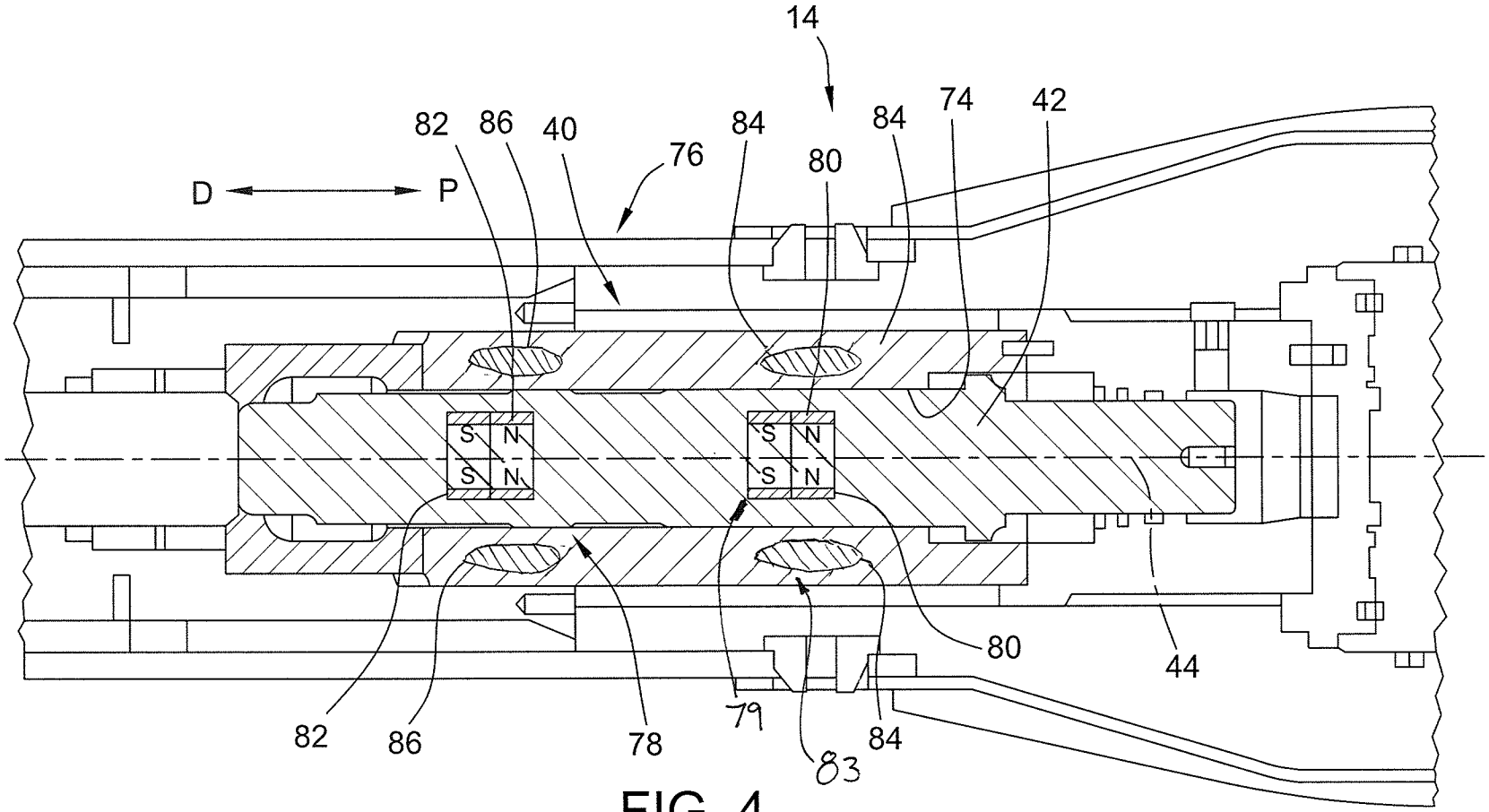
FIG. 4 is a partial cross-section view of the hydraulic hammer of FIG. 2 showing an electrodynamic bearing system in a power cell thereof with a piston at a lower working position relative to that illustrated in FIG. 3.

FIGS. 3 and 4 show a magnetic guide system 76 that provides a restoring force to a radially displaced piston 42 in a first embodiment of a hydraulic hammer 14. The hydraulic hammer 14 of FIG. 4 is in a first position in contact with the work tool and the hydraulic hammer of FIG. 3 is in a second position out of contact with the work tool.

The magnetic guide system 76 of the present embodiment includes elements of an electrodynamic bearing system 78. FIG. 3 illustrates a hydraulic hammer in an initial or starting position or state wherein the piston 42 is positioned proximally and FIG. 4 illustrates an extended position of the piston moved distally relative to the starting position.

The working principles of electrodynamic bearings (EDBs) are generally known in the art. The operation of an electrodynamic bearing is based on the induction of eddy currents in a conductor that moves through a magnetic field. When an electrically conducting material moves through a magnetic field, a current is generated in the material that counters the change in the magnetic field. In other words, the generated current in the object moving through the magnetic field results in a magnetic field created within the moving object that is oriented opposite to the magnetic field that the object is moving through. The electrically conducting material thus acts as a magnetic mirror. EDBs exploit the repulsive mirror forces generated by the eddy currents to achieve the maintenance of spacing between elements. In this case, the relative motion between the conductor and the magnetic field induces eddy currents inside the conductor, thereby generating forces that can be used to maintain a desired or selected spacing. Different configurations relying on the same basic principle are possible and unnecessary eddy current losses can be virtually eliminated.

The illustrated electrodynamic bearing system 78 includes at least one of a first magnetic guide component 79 in the piston 42. The first magnetic guide component 79 may be a pair of spaced axially magnetized ring magnets 80, 82. A first ring magnet 80 is positioned generally proximally (direction P) in the piston 42 and centered about the centerline 44 of the piston. A second ring magnet 82 is positioned generally distally (direction D) in the piston and centered about the centerline of the piston. The orientation of the poles of the ring magnets are the same, e.g., the south poles of both the first and second ring magnet 80, 82 are both provided at the distal ends thereof. The axial length of each of the first and second ring magnets 80, 82 is at least the length of the stroke of the piston 42. The piston 42 may be made of a non-magnetic material. In an alternative embodiment, the ring magnets 80, 82 may be constructed as electromagnets.

The illustrated electrodynamic bearing system 78 includes at least one of a second magnetic guide component 83 in the sleeve 72. The second magnetic guide component 83 may include a first conductive cylinder 84 and a second conductive cylinder 86 surrounding respectively the first and second ring magnets 80, 82. The conductive cylinders 84, 86 are disposed within the sleeve 72 and are also centered about the centerline 44 of the piston 42 such that when the piston is centered about the centerline, the ring magnets 80, 82 are respectively positioned concentrically within cylinders 84, 86 at least when the piston is in the initial or starting position shown in FIG. 3.

The axial length of each of the first and second conductive cylinders 84, 86 is greater than the axial length of the first and second ring magnets 80, 82. The conductive cylinders 84, 86 are formed of an electrically conductive material, such as copper. The sleeve 72 is made of a non-magnetic material.

The illustrated example of an electrodynamic bearing system 78 is based on passive magnetic technology. It does not require any control electronics to operate and works because electrical currents generated by relative motion between the piston 42 and sleeve 72 cause a restoring force. In one embodiment of such a system, the natural motion of the piston 42 generates the necessary relative motion to create the restoring force. Another example, (not shown) of an electrodynamic bearing system 78 is based on active magnetic control, the implementation of which is considered within the ability of one skilled in the art to execute.

In a hydraulic hammer 14 with the illustrated electrodynamic bearing system 78 of FIGS. 3 and 4, when the piston 42 is displaced from the centerline 44 in operation of the hydraulic hammer, the interaction of fields generated by the first and second ring magnets 80, 82 and the first and second conductive cylinder 84, 86 causes the generation of repositioning forces to re-center the piston in the sleeve 72. The repositioning forces are repulsive and greatest in the vicinity between the piston 42 and sleeve 72 where the gap therebetween is the narrowest in a displaced system. The repositioning forces are attractive but lesser in the vicinity between the piston 42 and sleeve 72 where the gap therebetween is the greatest in a displaced system.

Figure 5:
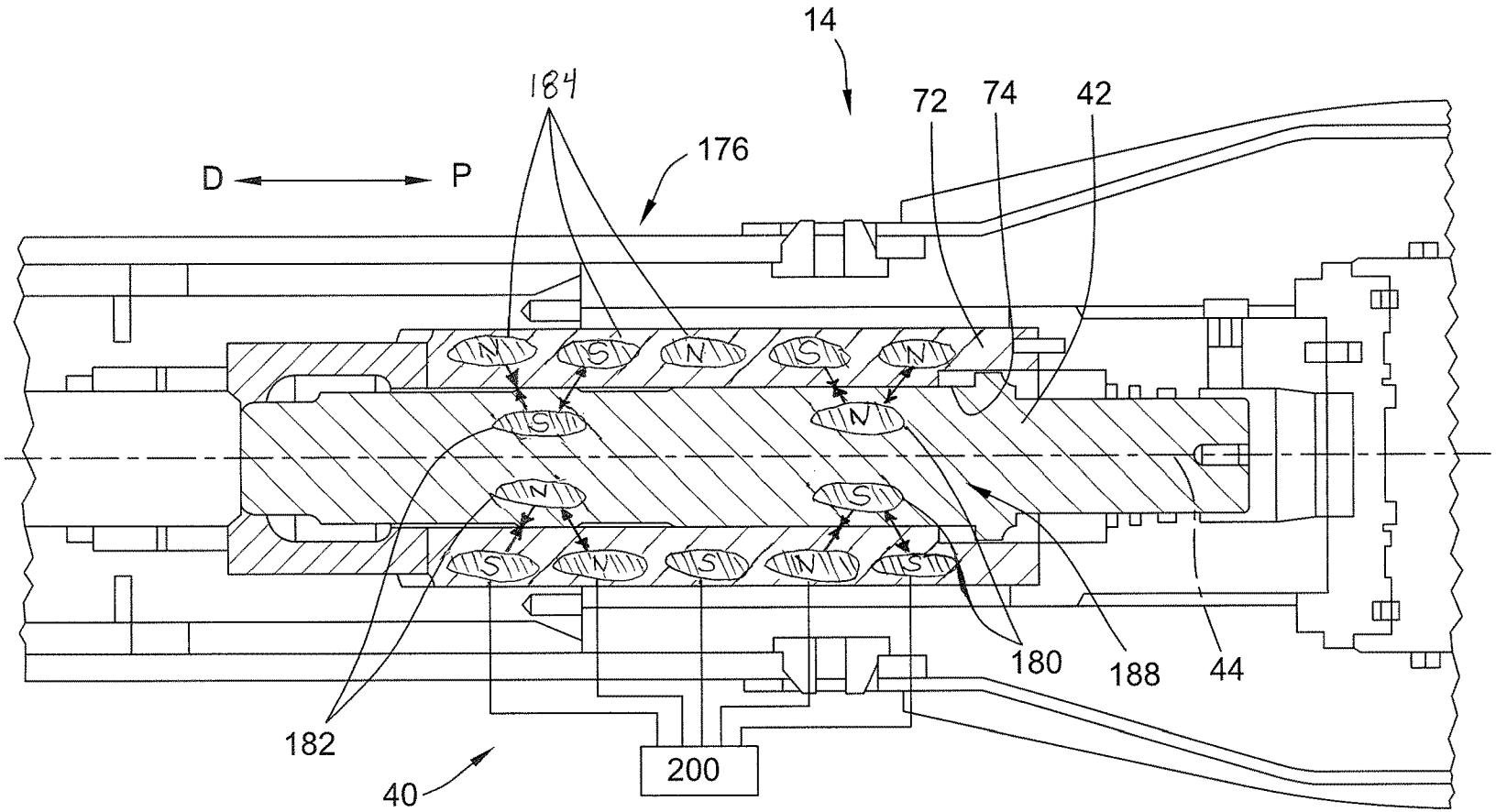
FIG. 5 is a partial cross-section view of the hydraulic hammer of FIG. 2 showing a magnetic suspension system in a power cell thereof.

FIG. 5 illustrates a further embodiment of a magnetic guide system 176 according to the disclosure. The hydraulic hammer 14 is shown with a magnetic guide system 176 including a magnetic suspension system 188 provided in power cell 40. The magnetic suspension system 188 is disposed in a hydraulic hammer 14 that is similar to that described above and generates a similar repositioning effect as the electrodynamic bearing system 78 of the system disclosed in FIGS. 3 and 4.

In particular, the magnetic guide system 176 includes first and second magnetic ring components 180, 182 in an axially spaced apart configuration and disposed within piston 42. The first and second magnetic ring components 180, 182 may be permanent magnets. The first and second magnetic ring components 180, 182 may be diametrically magnetized. Disposed in the sleeve 72 and generally surrounding the piston 42—in particular the portion of the piston containing the first and second magnetic ring components 180, 182—is an array of electromagnetic elements 184 arranged in a linear fashion or as a series.

In one embodiment, the array of electromagnetic elements 184 may be powered by a power source 200 connected to individual elements of the array. The power source 200 may energize each of the elements 184 of the array such that the magnetic fields generated alternate in adjacent elements. The power source 200 may include amplifiers and control and feedback circuitry as is known and may additionally respond to sensors that measure the distance between the piston 42 and sleeve 72 to maintain a selected gap therebetween.

Alternatively, the magnetic guide system 176 may generate its own electricity. When the piston 42 moves axially within the sleeve 72, the first and second magnetic ring components 180, 182 are also moved relative to the array of electromagnetic elements 184 in the sleeve. The magnetic fields of the first and second magnetic ring components 180, 182 cause a current in the array of electromagnetic elements 184 in the sleeve by inductance. The magnetic field thus generated creates a magnetic suspension force that urges the radial position of the piston towards the centerline 44, i.e., radially away from the electromagnetic elements 184, which extend peripherally around the piston. The implementation of magnetic guide system 176, according to the present disclosure, is considered within the ability of one skilled in the art to execute.

Figure 6:
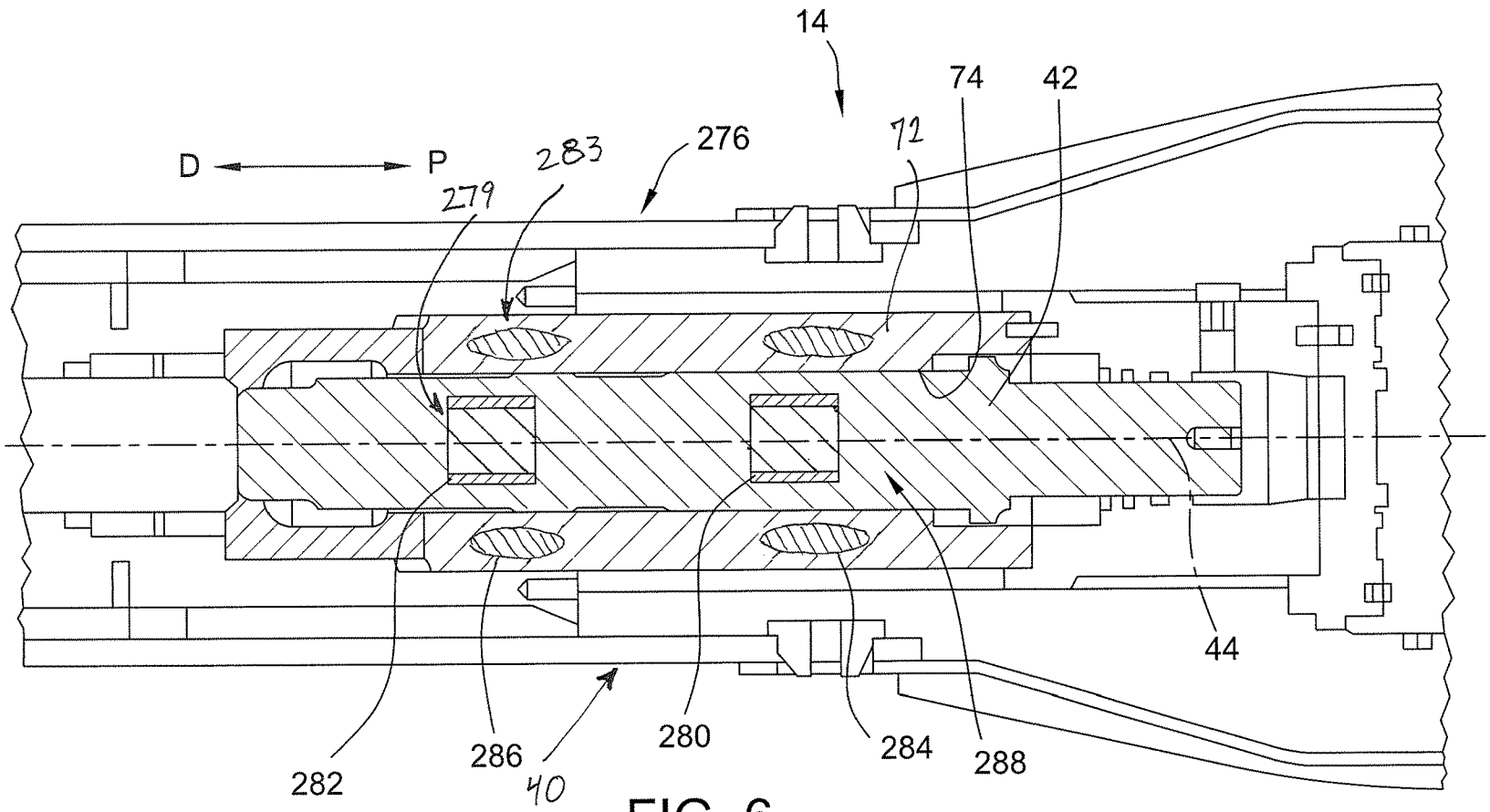
FIG. 6 is a partial cross-section view of the hydraulic hammer of FIG. 2 showing a diamagnetic suspension system in a power cell thereof.

FIG. 6 illustrates a magnetic guide system 267 comprising a diamagnetic suspension system 276. The diamagnetic suspension system 276 includes at least one of a first magnetic guide component 279 in the piston 42. The first magnetic guide component 279 may be a pair of spaced diamagnetic rings 280, 282. The pair of spaced diamagnetic rings 280, 282 may be solid or hollow cylinders. A first diamagnetic ring 280 is positioned generally proximally (direction P) in the piston 42 and centered about the centerline 44 of the piston and a second diamagnetic ring 282 is positioned generally distally (direction D) in the piston and centered about the centerline of the piston. The first and second diamagnetic rings 280, 282 may be made of any suitable diamagnetic material such as pyrolytic graphite, bismuth and the like.

The illustrated diamagnetic suspension system 276 includes at least one of a second magnetic guide component 283 in the sleeve 72. The second magnetic guide component 283 may include a first permanent magnet ring 284 and a second permanent magnet ring 286 surrounding respectively the first and second diamagnetic rings 280, 282. The first and second permanent magnet rings 284, 286 are disposed within the sleeve 72 and are also centered about the centerline 44 of the piston 42 such that when the piston is centered about the centerline, the first and second diamagnetic rings 280, 282 are respectively positioned concentrically within first and second permanent magnet rings 284, 286 at least when the piston is in the initial or starting position shown in FIG. 3. Additional magnetic rings may be disposed along the length of the cylinder. The axial length of each of the first and second permanent magnet rings 284, 286 is greater than the axial length of the first and second diamagnetic rings 280, 282. The axial length of the first and second diamagnetic rings 280, 282 is at least equal to the axial stroke of the piston 42.

In operation, diamagnetic materials create an induced magnetic field in a direction opposite to an externally applied magnetic field, and are repelled by the applied magnetic field. Thus, in the illustrated embodiment, the first and second diamagnetic rings 280, 282 are repelled by the externally applied magnetic field of the first and second permanent magnet rings 284, 286. In this manner, the piston 42, which contains the first and second diamagnetic rings 280, 282, is urged radially towards the centerline 44 of the power cell 40.

In accordance with the embodiments disclosed herein, galling and wear may be reduced within the hydraulic hammer.

INDUSTRIAL APPLICABILITY

The present disclosure is applicable to any form of hydraulic hammer and to any machine with a moving piston in which forces generated by motion of the piston are significant. In particular, where the motion of a piston exhibits deleterious lateral or radial motion, it would be advantageous to employ a magnetic guide system according to the disclosure. Systems according to embodiments of the disclosure provide a reduction of the deleterious motion and contribute to a reduction or elimination of galling and wear.

Although the disclosed embodiments have been described with reference to a hammer assembly in which the tool is driven by a hydraulically actuated piston, the disclosed embodiments are applicable to any tool assembly having a reciprocating work tool movable within a chamber by suitable drive structure and/or return structure. The disclosed embodiments encompass pneumatic tools and other impact tools.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A hydraulic hammer, comprising:

a power cell;

a work tool partially received in, and movable with respect to, the power cell;

a sleeve positioned in the power cell and defining a centerline;

a piston with a plurality of hydraulic surfaces, the piston concentrically positioned in the sleeve and movable in the sleeve between a first position in contact with the work tool and a second position out of contact with the work tool; and a magnetic guide system including at least one of a first magnetic guide component disposed in the piston and at least one of a second magnetic guide component disposed in the sleeve that interact to produce magnetic repellent forces therebetween to urge the radial position of the piston towards the centerline, wherein one of the first guide component or the second guide component includes a first ring magnet and a second ring magnet disposed in an axially spaced apart configuration in the piston, one of the first magnetic guide component or the second magnetic guide component includes a first conductive cylinder and a second conductive cylinder, the first and second conductive cylinders disposed adjacent and extending concentrically around respective ones of the first and second ring magnets.

2. The hydraulic hammer of claim 1, wherein the magnetic guide system includes an electrodynamic bearing system.

3. The hydraulic hammer of claim 1, wherein the piston has a stroke and the first and second ring magnets have a first axial length, the first axial length greater than the stroke.

4. The hydraulic hammer of claim 1, wherein the first and second ring magnets have a first axial length and the first and second conductive cylinders have a second axial length, the first axial length less than the second axial length.

5. The hydraulic hammer of claim 1, wherein the magnetic guide system includes a magnetic suspension system.

6. The hydraulic hammer of claim 5, wherein the first magnetic guide component of the magnetic suspension system includes a first magnetic ring component and a second magnetic ring component disposed in an axially spaced apart configuration in the piston.

7. The hydraulic hammer of claim 6, wherein the first and second magnetic ring components are permanent magnets.

8. The hydraulic hammer of claim 7, wherein the first and second magnetic ring components are diametrically magnetized.

9. The hydraulic hammer of claim 7, wherein the second magnetic guide component of the magnetic suspension system includes an array of electromagnetic elements disposed adjacent the first and second permanent magnets.

10. The hydraulic hammer of claim 9, further comprising a power source in operative communication with the array of electromagnetic elements.

11. The hydraulic hammer of claim 1, wherein the piston and sleeve are made of non-magnetic materials.

12. A machine, comprising:

an implement system attached to the machine;

a hydraulic hammer attached to the implement system, the hydraulic hammer comprising:

a power cell;

a work tool partially received in, and movable with respect to, the power cell;

a sleeve positioned in the power cell and defining a centerline;

a piston with a plurality of hydraulic surfaces, the piston concentrically positioned in the sleeve and movable in the sleeve between a first position in contact with the work tool and a second position out of contact with the work tool; and a magnetic guide system including at least one of a first magnetic guide component disposed in the piston and at least one of a second magnetic guide component disposed in the sleeve that interact to produce magnetic repellent forces therebetween to urge the radial position of the piston towards the center line, one of the first magnetic guide component and the second magnetic guide component comprising a pair of spaced apart ring magnets, each ring magnet having a first end and a second end, the first and second ends having opposite poles, and an axis extending between the first and second ends, the axis being collinear with the centerline of the sleeve.

13. The hydraulic hammer of claim 12, wherein the magnetic guide system includes one of an electrodynamic bearing system, a magnetic suspension system, and diamagnetic suspension system.

14. The hydraulic hammer of claim 1, wherein the first and second axially spaced apart ring magnets each have a first end and a second end, the first and second ends have opposite poles, and an axis extends between the first and second ends and is collinear with the centerline of the sleeve.

15. A hydraulic hammer, comprising:

a power cell;

a work tool partially received in, and movable with respect to, the power cell;

a sleeve positioned in the power cell and defining a centerline;

a piston with a plurality of hydraulic surfaces, the piston concentrically positioned in the sleeve and movable in the sleeve between a first position in contact with the work tool and a second position out of contact with the work tool; and a magnetic guide system including at least one of a first magnetic guide component disposed in the piston and at least one of a second magnetic guide component disposed in the sleeve that interact to produce magnetic repellent forces therebetween to urge the radial position of the piston towards the centerline, the magnetic guide system including a diamagnetic suspension system having a diamagnetic ring and a permanent magnet ring, the diamagnetic ring and the permanent magnet ring being disposed concentrically about the centerline, and one of the diamagnetic ring and the permanent magnet ring extending concentrically around another of the diamagnetic ring and the permanent magnet ring.

* * * * *